US005565637A

United States Patent [19]

Shigenaga

[11] Patent Number: 5,565,637

[45] Date of Patent: Oct. 15, 1996

[54] FOOT PEDAL FOR A DRUM

[75] Inventor: Fumihiro Shigenaga, Hamamatsu, Japan

[73] Assignee: Yamaha Corporation, Shizuoka-ken, Japan

[21] Appl. No.: 461,205

[22] Filed: Jun. 5, 1995

[30] Foreign Application Priority Data

Dec. 6, 1994 [JP] Japan ..... 6-301968

[51] Int. Cl.[6] ..... G10D 13/02

[52] U.S. Cl. ..... 84/422.1

[58] Field of Search ..... 84/422.1, 422.2, 84/422.3, DIG. 12

[56] References Cited

U.S. PATENT DOCUMENTS 4,134,325 1/1979 Loftus ..... 84/422 R
4,262,576 4/1981 Gorsky et al. ..... 84/422 R
4,819,536 4/1989 Lombardi ..... 84/DIG. 12

FOREIGN PATENT DOCUMENTS 55-11033 3/1980 Japan ..... G10D 13/02
4-96794 8/1992 Japan ..... G10D 13/02

*Primary Examiner*—Patrick J. Stanzione
*Attorney, Agent, or Firm*—Koda and Androlia

[57] ABSTRACT

A foot pedal for a drum including a drum hoop receiving member. The drum hoop receiving member has the shape of an inverted triangle when viewed from the side and is pivotably provided on the beater holding portion of the pedal frame. When the drum hoop of a bass drum is placed on the hoop receiving member, the hoop receiving member pivots in accordance with the setting angle of the drum and makes a surface contact with the drum hoop so that the bass drum is securely held on the hoop receiving member regardless of the setting angle of the drum.

1 Claim, 4 Drawing Sheets

FOOT PEDAL FOR A DRUM

BACKGROUND OF THE INVENTION

1. Field of the Invention

The present invention relates to a foot pedal for a drum in which the drum head of a bass drum is struck when the foot pedal is depressed with the foot and more particularly to a drum foot pedal wherein the tightening frame (hereafter referred to as a "hoop") of the bass drum can be stably and securely positioned in accordance with the setting angle of the drum.

2. Prior Art

Conventionally, drum foot pedals of this type are constructed so that a beater is pivoted by the depression of a foot board installed on a pedal frame, thus striking the drum head of a bass drum (see Japanese Utility Model Application Publication No. 55-110033, etc.). The bass drum 1 is, as shown in FIG. 6, positioned in front of the foot pedal 2, and the lower end portion of a hoop 3 which is an annular body installed around the circumference of the bass drum 1 is placed on the hoop holding portion 4*a* of a pedal frame 4 and positioned in place by a clamping member 5 which presses against the hoop 3. The clamping member 5 is provided at roughly a central position of a horizontal shaft 6 which is provided on the pedal frame 4 in a manner that the clamping member 5 is free to pivot in the forward-backward direction. The front end portion of the clamping member 5 constitutes a hoop pressing portion 5*a*, and a hoop fastening screw 7 is installed on the rear end portion of the clamping member 5. When this screw 7 is rotated to cause the clamping member 5 to pivot in the counterclockwise direction in figure, the hoop pressing portion 5*a* presses against the hoop 3 so that the hoop 3 is positioned in place on the hoop holding portion 4*a*.

However, in the conventional drum foot pedal 2, the hoop holding portion 4*a* of the pedal frame 4 has a flat surface and is not changeable in angle. Accordingly, when the bass drum 1 is set to be inclined forward (toward the drummer) at a prescribed angle as shown in Figure, the hoop 3 is also inclined so that only the front edge is down. As a result, only the undersurface of the front edge of the hoop 3 comes into contact with the upper surface of the hoop holding portion 4*a* so that a gap 8 is created between the hoop 3 and the hoop holding portion 4*a*. Thus, because of the gap 8, the hoop 3 is not stably and securely positioned even if the hoop 3 is pressed against the hoop holding portion 4*a* by the clamping member 5. In addition, if the hoop 3 is strongly pressed by the clamping member 5, the hoop 3 may be deformed or broken.

SUMMARY OF THE INVENTION

Accordingly, the present invention is devised in light of the conventional problems, and the object of the present invention is to provide a drum foot pedal which is designed so that the hoop can be stably and securely positioned by a large pressing force regardless of the setting angle of the bass drum, and deformation and breakage, etc. of the hoop can be prevented.

In order to accomplish the object, the invention is characterized in that in a foot pedal for a drum comprising a pedal frame on which a foot board is provided, a beater which is caused to pivot by the depression of the foot board so as to strike the drum head, and a clamping member which is installed on the pedal frame so as to hold the hoop of a bass drum in place by pressing against the hoop, a hoop receiving member is pivotally provided on the pedal frame so as to face the clamping member, thus clamping the hoop with this hoop receiving member and the clamping member.

Furthermore, in the foot pedal of the present invention, the hoop receiving member has the shape of an inverted triangle when seen from the side, the upper surface of the hoop receiving member forms a hoop receiving surface, and the hoop receiving member is supported by a shaft so that the hoop receiving member is free to pivot in the forward-backward direction.

In the present invention, the hoop receiving member is pivotable; accordingly, when the hoop is placed on the hoop receiving member, the hoop receiving member pivots in accordance with the angle of the hoop so as to make surface contact with the hoop. Furthermore, the hoop receiving member is formed in the shape of an inverted triangle when seen from the side, and the hoop receiving member can pivot at a considerably large angle in the forward-backward direction without interfering with the pedal frame of the pedal; accordingly, the hoop receiving member can meet a large setting angle of the bass drum.

BRIEF DESCRIPTION OF THE INVENTION

DETAILED DESCRIPTION OF THE INVENTION

Below, the present invention will be described in detail in terms of an embodiment which is illustrated in the accompanying drawings.

Figure 1:
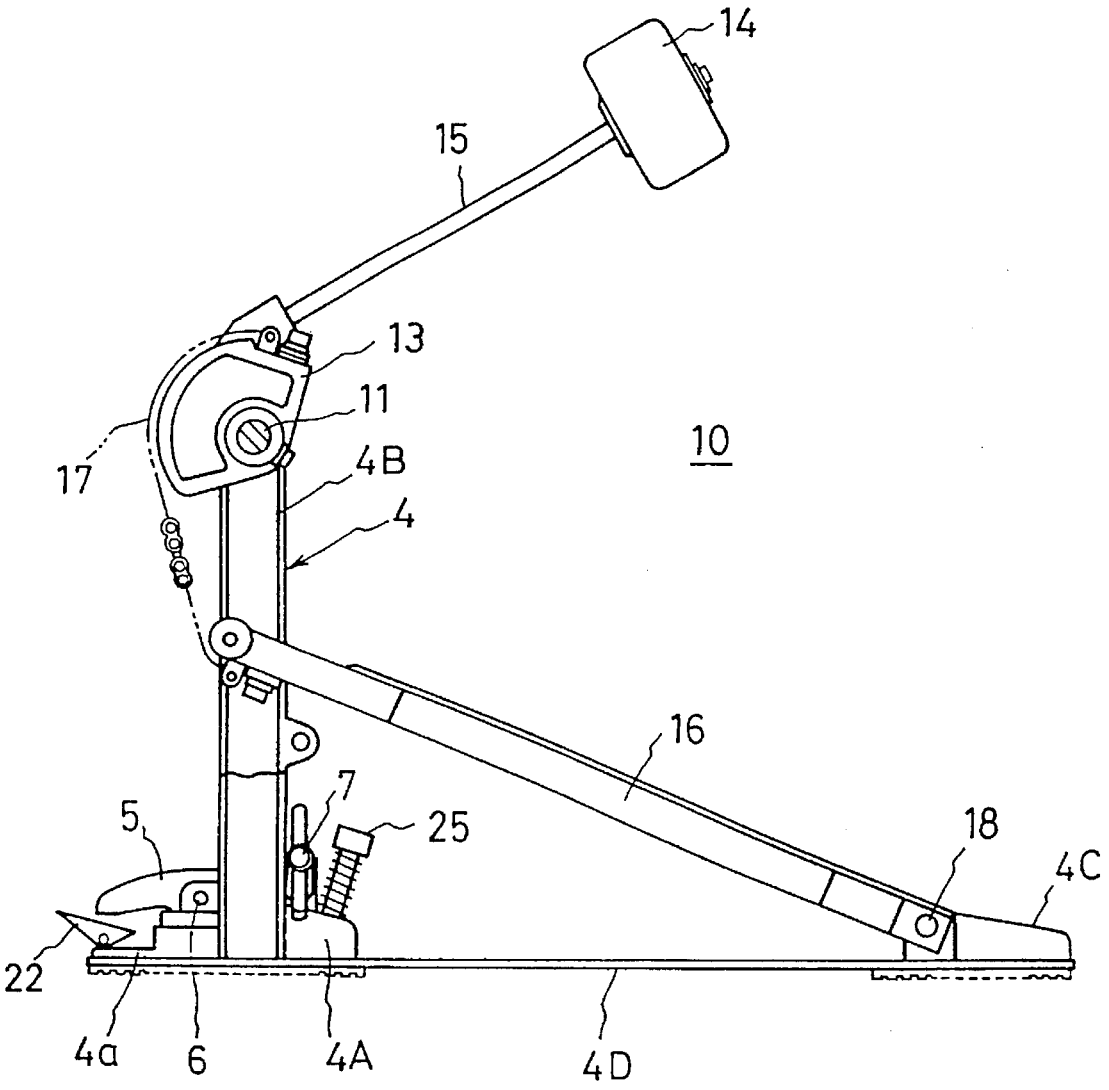
FIG. 1 is a partially sectional side view of one embodiment of the drum foot pedal of the present invention.
Figure 2:
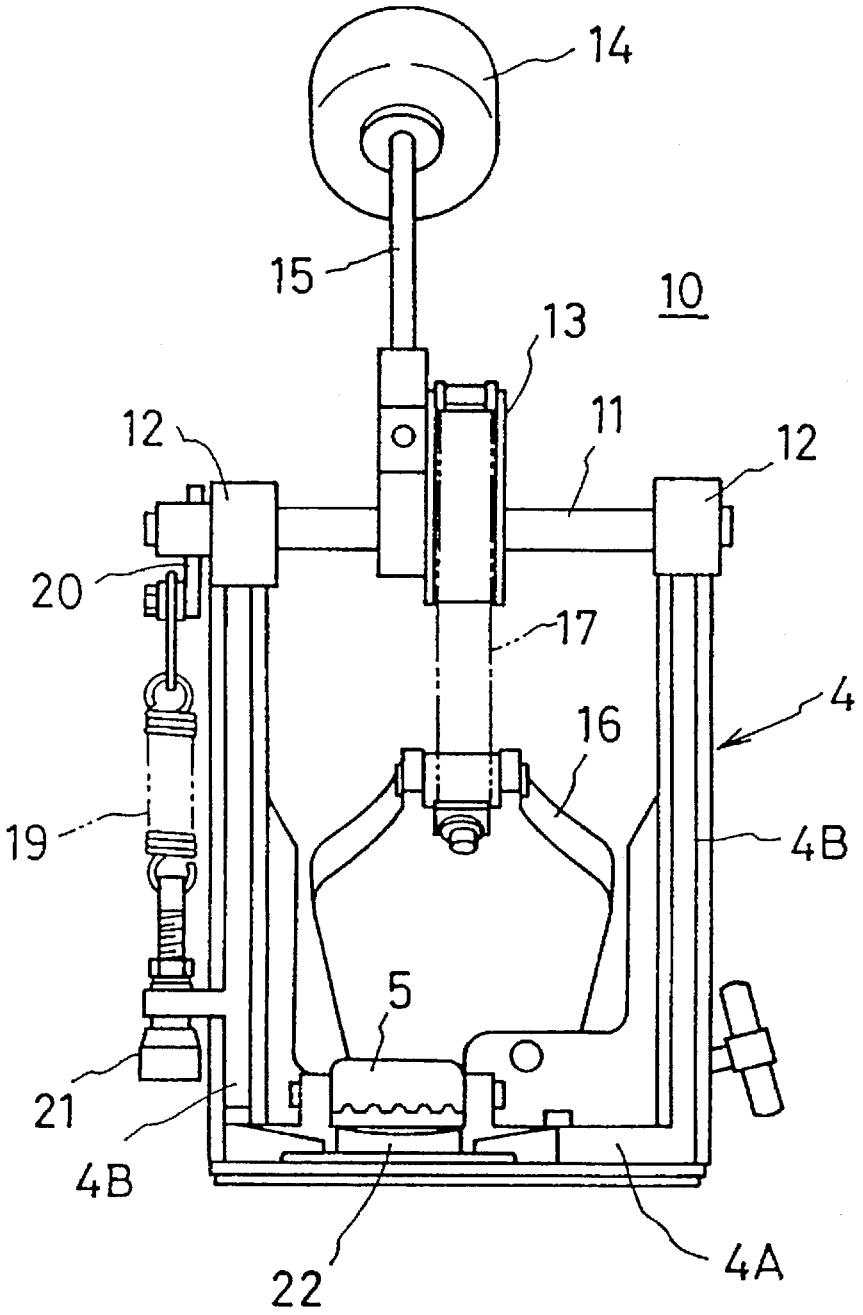
FIG. 2 is a front view of the same foot pedal.
Figure 3:
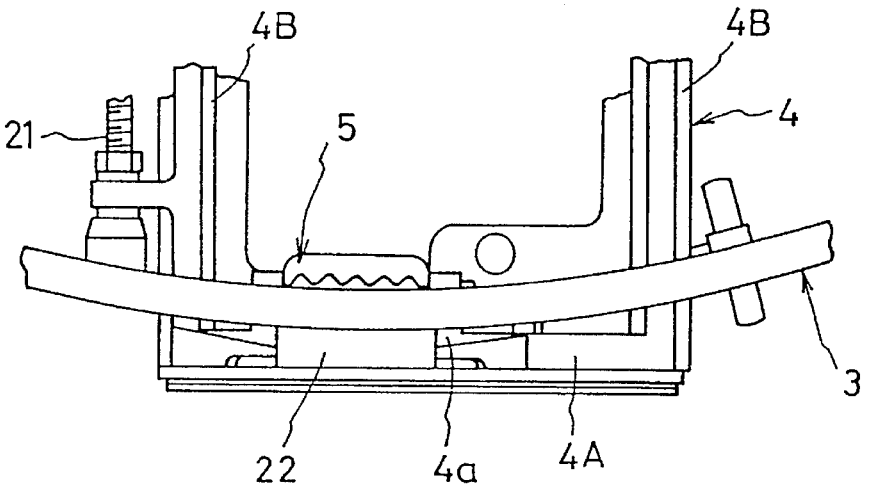
FIG. 3 is an enlarged front view of the hoop holding portion.
Figure 4:
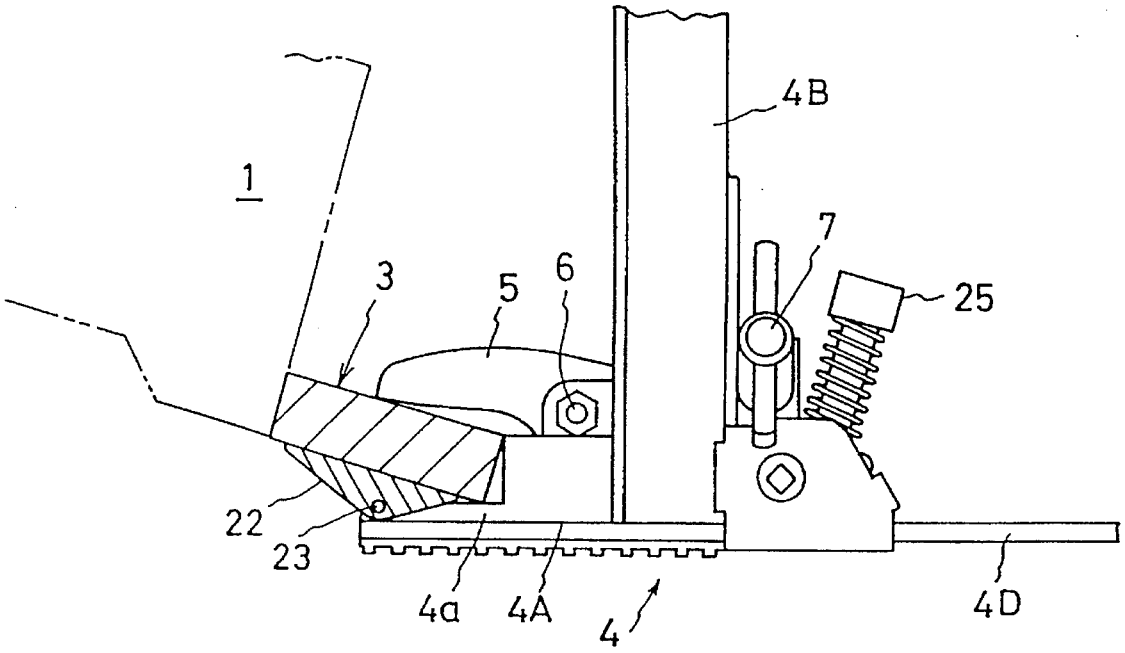
FIG. 4 is a sectional side view showing the hoop set on the hoop receiving member.
Figure 5:
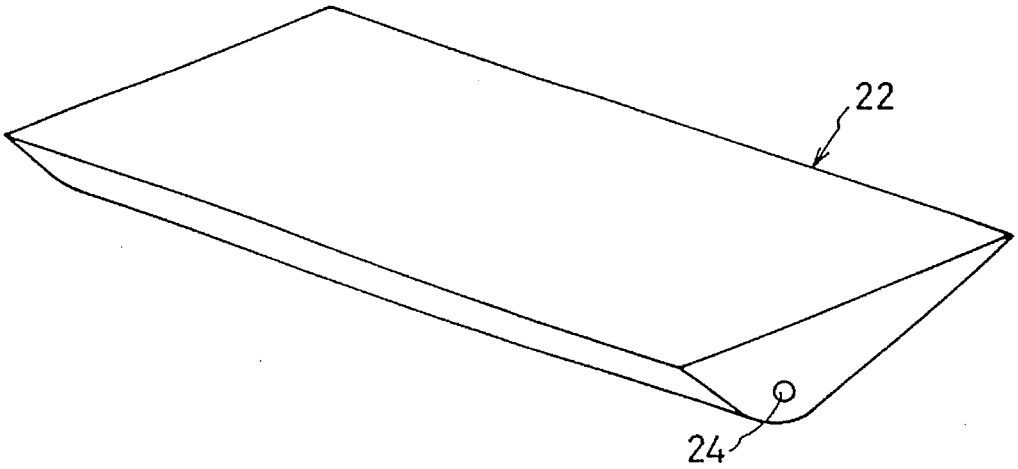
FIG. 5 is a perspective view of the hoop receiving member.
Figure 6:
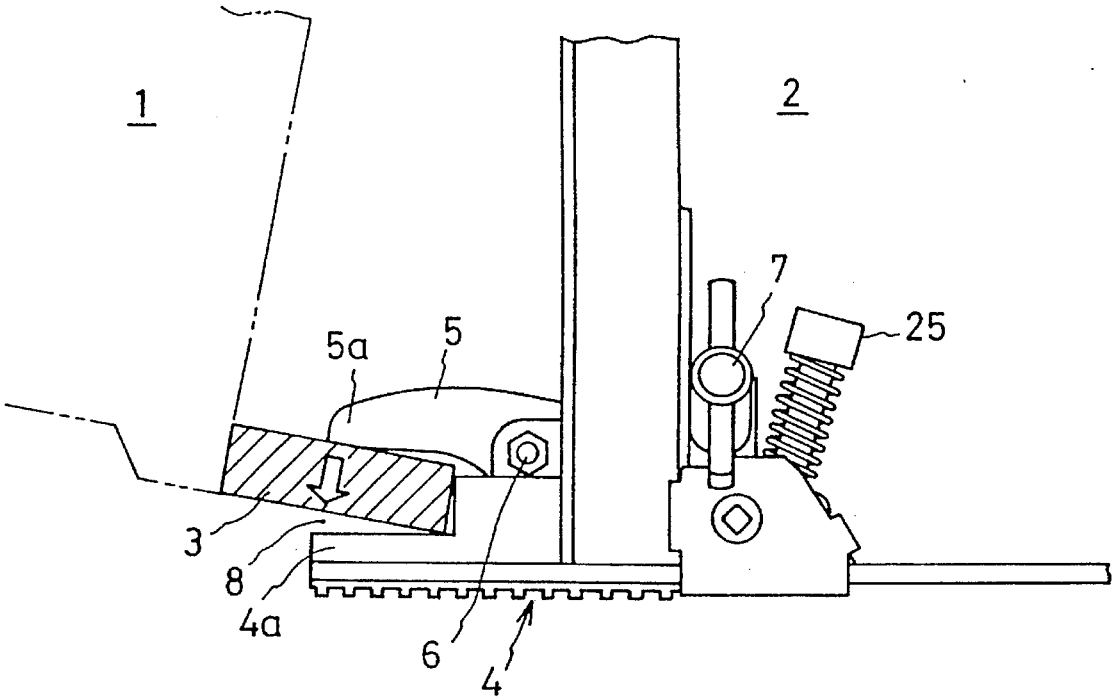
FIG. 6 is a sectional side view of a conventional example of a drum foot pedal.

FIG. 1 is a partially sectional side view of one embodiment of the drum foot pedal of the present invention. FIG. 2 is a partially sectional front view of the same foot pedal. FIG. 3 is an enlarged front view of the hoop holding portion. FIG. 4 is a side view of the same hoop holding portion. FIG. 5 is a perspective view of the hoop receiving member. In these Figures, constituent elements which are the same as in FIG. 6 are indicated by the same symbols. In figures, the drum foot pedal 10 includes the pedal frame 4 which is placed on the floor surface. This pedal frame 4 is constructed from a frame main body 4A, a pair of right and left supporting columns 4B which are installed in upright positions on the upper surface of the frame main body 4A, and a heel 4C which is connected to the frame main body 4A via a connecting member 4D, etc. The clamping member 5 which clamps and fastens the hoop 3 of the bass drum 1 together with a hoop receiving member which is described later is provided on the frame main body 4A. A rotatable shaft 11 is installed between the upper ends of the pair of supporting columns 4B, 4B via bearings 12 so that the rotatable shaft 11 is free to rotate, and a rocker 13 is attached to the center of the rotatable shaft 11. A beater 14 which strikes the drum head of the bass drum 1 is installed on the rocker 13 via a beater rod 15, and the upper end of a pedal depressing force transmission member 17 which transmits the depressing force of a foot board 16 to the beater 14 is connected to the rocker 13. In this embodiment, a chain is used as the pedal depressing force transmission member 17; however, the present invention is not limited to the chain, and it is possible to use a timing belt or a flexible leather or plastic band, etc. The foot board 16 is formed as a flat plate of sufficient size to accommodate the foot. The from end of the foot board 16 is connected to the lower end of the pedal depressing force transmission member 17, and the rear end of the foot board 16 is connected to the heel 4C via a shaft 18 so that the foot board 16 is free to pivot upward and downward. The upper end of a return spring 19 which imparts a pivoting habit to the foot board 16 in the return direction is connected to one end of the rotatable shaft 11 via a cam plate 20, and the lower end of the return spring 19 is connected to a spring receiving member 21 which is provided on the lower end portion of one of the supporting columns 4B.

The hoop holding portion **4*a* which holds and fastens the hoop 3 of the bass drum 1 in place is provided on the central portion of the front surface of the frame main body 4A. Furthermore, the clamping member 5, which presses against the hoop 3, and a hoop receiving member 22 are installed so as to face each other above and below on this hoop holding portion 4*a***.

The central portion of the clamping member 5 is supported by the shaft 6 so that the clamping member 5 is free to pivot upward and downward. The hoop fastening screw 7 is coupled to the rear end (i.e., the end nearest the drummer) of the clamping member 5. The tip end of this fastening screw 7 is in contact with the upper surface of the frame main body 4A. When the fastening screw 7 is rotated in the tightening direction, the clamping member 5 is caused to pivot in the counterclockwise direction in FIG. 1; as a result, the front end of the clamping member 5 can press the hoop 3 against a hoop receiving surface which is the upper surface of the hoop receiving member 22 so that the hoop 3 is secured in place.

As shown in FIGS. 4 and 5, the hoop receiving member 22 is a plate which has the shape of an inverted triangle when seen from the side. The hoop receiving member 22 is provided so as to face the hoop holding portion **4*a* of the petal frame 4 and is supported on a horizontal shaft 23 which is provided at the tip end of the hoop holding portion 4*a* so that the hoop receiving member 22 is free to pivot in the forward-backward direction. The shaft 23 is passed though a shaft receiving hole 24 which is formed in the lower central portion of the hoop receiving member 22, and both ends of the shaft 23 are supported by the frame main body 4A. The reason that the hoop receiving member 22 is formed in a triangular cross-sectional shape is that this shape can prevent interference with the hoop holding portion 4a and make it possible to obtain a large pivoting angle. Furthermore, the anchor screw 25 which prevents the drum foot pedal 10 and bass drum 1 from moving due to the shock that occurs when the foot board 16 is depressed is provided on the upper surface of the pedal frame main body 4A**.

With the above-described structure for the drum foot pedal 10, when the bass drum 1 is set up, the lower surface of the hoop 3 is placed on the hoop receiving member 22, the bass drum 1 is set at a desired setting angle, and the hoop fastening screw 7 is rotated so that the hoop 3 is pressed against the hoop receiving member 22 by the clamping member 5. In this case, when the hoop 3 is placed on the hoop receiving member 22, the hoop receiving member 22 pivots in accordance with the angle of the hoop 3; thus the hoop receiving member 22 can make surface contact with the undersurface of the hoop 3 as shown in FIG. 4.

When the foot board 16 is depressed during playing of the drum so that the pedal depressing force transmission member 17 is pulled down, the rotatable shaft 11 rotates in the counterclockwise direction in FIG. 1. As a result, the beater 14 pivots together with the rotatable shaft 11 and strikes the drum head of the bass drum 1. In this case, the maximum angle of depression of the foot board 16 is approximately 15°. When the depressing force is removed from the foot board 16 after the beater 14 has struck the drum head, the foot board 16 is forced to pivot upward by the spring force of the return spring 19, so that the foot board 16 returns to its initial position.

Thus, in the drum foot pedal 10 constructed as described above, the hoop receiving member 22 which is pivotable is installed on the hoop holding portion **4*a* of the pedal frame 4, and the hoop 3 is placed on this hoop receiving member 22. As a result, the hoop receiving member 22 pivots and makes surface contact with the hoop 3 regardless of the setting angle at which the drum 1 is set. Accordingly, no gap is created between the hoop 3 and the hoop receiving member 22, and the pressing force of the clamping member 5 can be assuredly transmitted to the hoop 3, so that the hoop 3 is stably and securely positioned by a large pressing force. Furthermore, since the hoop 3 is brought into surface contact with the hoop receiving member 22, deformation and breakage of the hoop 3** can be prevented.

Moreover, since the hoop receiving member 22 is formed in the shape of an inverted triangle when viewed from the side, the hoop receiving member 22 can pivot considerably in the forward-backward direction without interfering with the hoop holding portion **4*a***, thus being able to handle a large setting angle of the bass drum.

In the above embodiment, the present invention is applied to a drum foot pedal that includes the pedal frame 4 which has the supporting columns 4B. However, the present invention is not limited to this arrangement. It goes without saying that the present invention can be applied to a drum foot pedal which has a single supporting column.

Moreover, in the embodiment, the drum foot pedal has a single clamping member 5. However, it is also possible to have two clamping members. In this case, the number of hoop receiving members 22 is increased accordingly.

As described above, the drum foot pedal of the present invention is characterized in that in foot pedal for a drum which includes a pedal frame on which a foot board is installed, a beater which is caused to pivot by the depression of the foot board so that the beater strikes the drum head, and a clamping member which is installed on the pedal frame and hold the hoop of a bass drum in place by pressing against the hoop, a hoop receiving member is installed on the pedal frame so as to face the clamping member in a manner that the hoop receiving member is free to pivot, and the hoop of the drum is clamped by this hoop receiving member and the clamping member. Accordingly, surface contact can be obtained between the hoop and the hoop receiving member regardless of the setting angle of the bass drum with no gap between the hoop and the hoop receiving member. Thus, the hoop can be stably and securely held in place by means of a large fastening force, and deformation, breakage, etc. of the hoop is prevented. Furthermore, since it is only necessary to employ the hoop receiving member, the structure is simple.

In addition, since the hoop receiving member used in the present invention has the shape of an inverted triangle when viewed from the side, the hoop receiving member will not interfere with the pedal frame when the hoop receiving member pivots in the forward-backward direction. Accordingly, a large pivoting angle can be obtained.

I claim:

1. A foot pedal for a drum characterized in that in a foot pedal for a drum comprising a pedal frame on which a foot board is installed, a beater which is caused to pivot by the depression of the foot board so that the beater strikes the drum head, and a clamping member which is installed on the pedal frame so as to hold the hoop of a bass drum in place by pressing against the hoop, a hoop receiving member is pivotally installed on the pedal frame so as to face the clamping member so that the hoop is clamped by the hoop receiving member and the clamping member and wherein the hoop receiving member has a shape of an inverted triangle when seen from the side, the upper surface of the hoop receiving member forms a hoop receiving surface, and the hoop receiving member is supported by means of a shaft so that the hoop receiving member is free to pivot in a forward-backward direction.

* * * * *